US009163824B2

(12) United States Patent
Chen et al.

(10) Patent No.: US 9,163,824 B2
(45) Date of Patent: Oct. 20, 2015

(54) LAMP HEAT SINK

(71) Applicant: Technical Consumer Products, Inc., Aurora, OH (US)

(72) Inventors: Timothy Chen, Aurora, OH (US); George Uhler, Wadsworth, OH (US)

(73) Assignee: TECHNICAL CONSUMER PRODUCTS, INC., Aurora, OH (US)

( * ) Notice: Subject to any disclaimer, the term of this patent is extended or adjusted under 35 U.S.C. 154(b) by 225 days.

(21) Appl. No.: 13/889,034

(22) Filed: May 7, 2013

(65) Prior Publication Data

US 2013/0294097 A1 Nov. 7, 2013

Related U.S. Application Data

(60) Provisional application No. 61/643,621, filed on May 7, 2012.

(51) Int. Cl.

| | |
|---|---|
| ***F21V 29/00*** | (2015.01) |
| ***F28F 3/02*** | (2006.01) |
| ***F21V 29/70*** | (2015.01) |
| ***F21K 99/00*** | (2010.01) |
| ***F21V 29/505*** | (2015.01) |
| ***F21V 29/71*** | (2015.01) |
| ***F21V 29/74*** | (2015.01) |
| ***F21V 29/77*** | (2015.01) |
| ***F21V 29/83*** | (2015.01) |
| *F21V 3/00* | (2015.01) |
| *F21Y 101/02* | (2006.01) |

(52) U.S. Cl.

CPC ..... *F21V 29/2206* (2013.01); *F21K 9/135* (2013.01); *F21K 9/50* (2013.01); *F21V 29/505* (2015.01); *F21V 29/70* (2015.01); *F21V 29/713* (2015.01); *F21V 29/74* (2015.01); *F21V 29/77* (2015.01); *F21V 29/83* (2015.01); *F28F 3/02* (2013.01); *F21V 3/00* (2013.01); *F21Y 2101/02* (2013.01)

(58) Field of Classification Search

CPC ..... F21V 29/70; F21V 29/004; F21V 29/22
USPC ..... 362/294
See application file for complete search history.

(56) References Cited

U.S. PATENT DOCUMENTS

| | | | | |
|---|---|---|---|---|
| 8,167,460 | B2 * | 5/2012 | Chu | 362/294 |
| 2007/0097692 | A1 | 5/2007 | Suehiro et al. | |
| 2008/0157112 | A1 * | 7/2008 | He et al. | 257/98 |
| 2009/0296387 | A1 | 12/2009 | Reisenauer et al. | |

(Continued)

OTHER PUBLICATIONS

International Search Report, PCT/US2013/039946, Jul. 11, 2013.

(Continued)

*Primary Examiner* — Evan Dzierzynski
(74) *Attorney, Agent, or Firm* — Thompson Hine LLP

(57) ABSTRACT

A lamp heat sink includes a plurality of heat dissipating fins disposed around a body and extending away from the body. The lamp heat sink further comprises a heat dissipating circumferent skirt surrounding the body and disposed between the plurality of heat dissipating fins. The lamp heat sink further comprises a plurality of channels disposed around the body, formed by the plurality of heat dissipating fins and the heat dissipating circumferent skirt. The plurality of channels each include an intake opening configured to receive cold air and an exhaust opening configured to release warm air.

17 Claims, 2 Drawing Sheets

(56) References Cited

U.S. PATENT DOCUMENTS

| | | | | |
|---|---|---|---|---|
| 2009/0303735 | A1 | 12/2009 | Chen | |
| 2010/0091487 | A1* | 4/2010 | Shin | 362/235 |
| 2010/0132931 | A1 | 6/2010 | Liaw et al. | |
| 2011/0051430 | A1* | 3/2011 | Chen | 362/373 |
| 2012/0106140 | A1 | 5/2012 | Sun et al. | |

OTHER PUBLICATIONS

International Preliminary Report on Patentability, PCT/US2013/039946, Nov. 20, 2014.

* cited by examiner

LAMP HEAT SINK

CROSS-REFERENCE TO RELATED APPLICATION

This application claims priority from U.S. Provisional Patent Application No. 61/643,621 filed on May 7, 2012, which is incorporated by reference herein in its entirety.

FIELD OF INVENTION

The present disclosure relates to the field of light bulbs. More particularly, the present invention relates to a lamp heat sink.

BACKGROUND

An LED lamp consists of, among other components, a heat sink to help cool the lamp by dissipating emitted heat to the surrounding air. A heat sink helps ensure that the lamp operates properly, even at high temperatures. The amount of heat that a heat sink is able to dissipate depends on the surface area of a heat sink. The larger the surface area, the more heat a heat sink is able to dissipate. Increasing surface area, however, may increase the dimensions of the heat sink which may result in a larger a larger lamp.

Increasing the size of the lamp may not be desirable, however. When designing a retrofit LED lamp to replace an incandescent lamp, for example, it is desirable that the replacement lamp approximate or closely resemble a standard form factor of the incandescent lamp being replaced. Otherwise, the replacement lamp may not properly fit the application for which it was intended. Increasing the size of the heat sink may also result in increased costs of manufacturing the lamp. Thus, it may be desirable to increase the surface area of a heat sink without increasing the size of the heat sink and without increasing the cost of manufacturing the heat sink.

SUMMARY OF THE INVENTION

A lamp heat sink includes a plurality of heat dissipating fins disposed around a body and extending away from the body. The lamp heat sink further comprises a heat dissipating circumferent skirt surrounding the body and disposed between the plurality of heat dissipating fins. The lamp heat sink further comprises a plurality of channels disposed around the body, formed by the plurality of heat dissipating fins and the heat dissipating circumferent skirt. The plurality of channels each include an intake opening configured to receive cold air and an exhaust opening configured to release warm air.

A heat sink includes a plurality of heat dissipating fins disposed around a body and extending away from the body. The heat sink further includes a plurality of channels surrounding the body, the plurality of channels being defined by a plurality of heat dissipating inserts, disposed between the plurality of fins, parallel to the body. The heat sink further includes a plurality of intake openings configured to receive cold air in the plurality of channels. The heat sink further includes a plurality of exhaust openings configured to release warm air from the plurality of the channels.

BRIEF DESCRIPTION OF THE DRAWINGS

In the accompanying drawings, structures are illustrated that, together with the detailed description provided below, describe exemplary aspects of the present invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1:
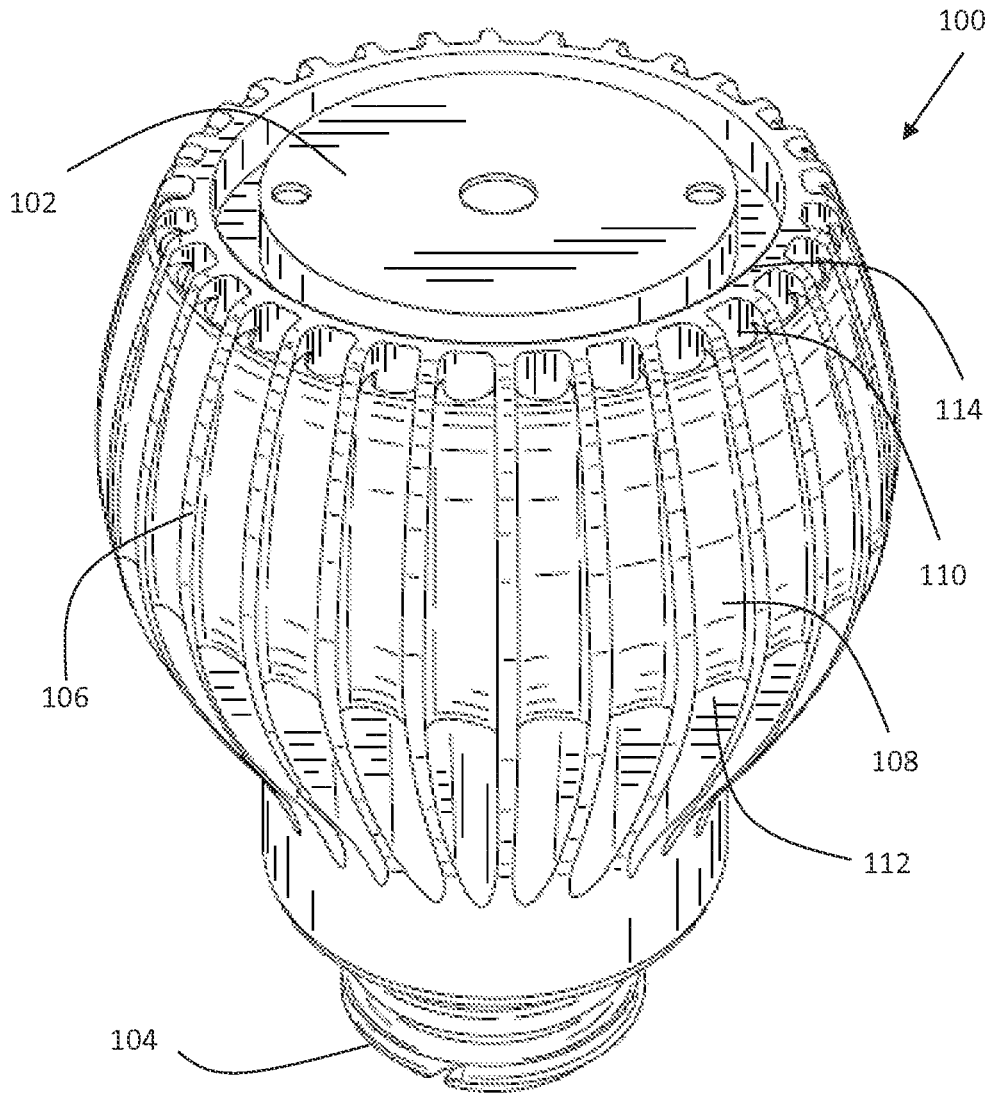
FIG. 1 is a perspective view of a lamp heat sink, according to one aspect of the present invention.
Figure 2:
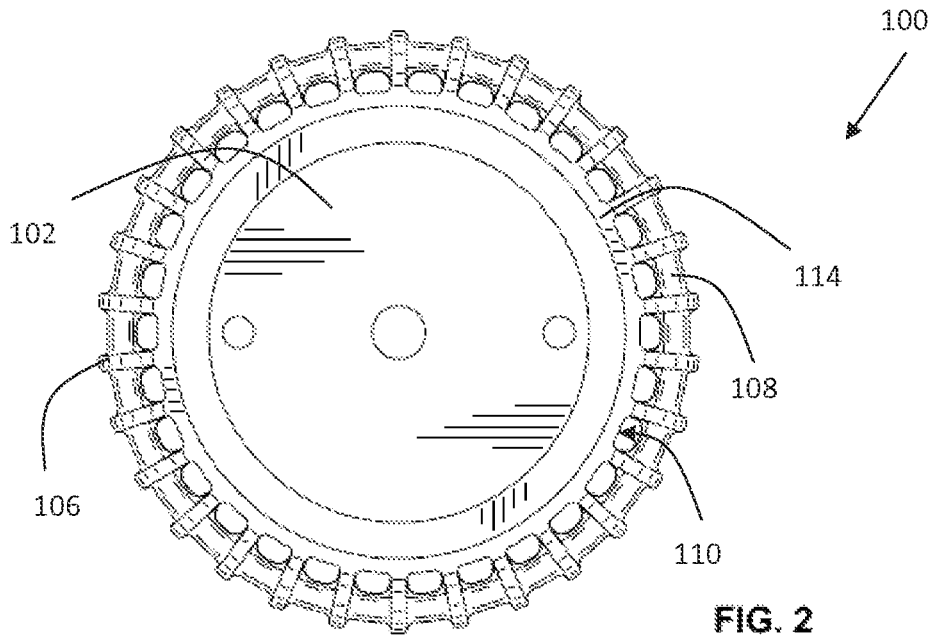
FIG. 2 is a top view of the lamp heat sink of FIG. 1, according one aspect of the present invention.
Figure 3:
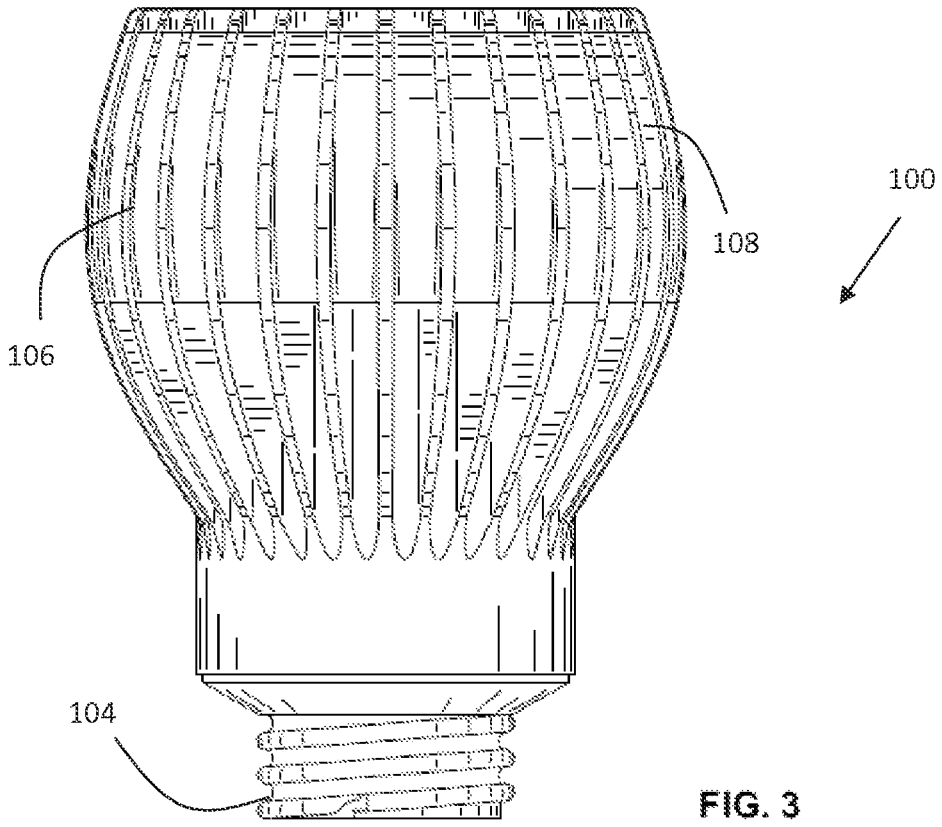
FIG. 3 is a side view of the heat sink of FIG. 1, according one aspect of the present invention.

FIG. 1 is a perspective view of a lamp heat sink 100, according to one aspect of the present invention. FIGS. 2 and 3 are top and side views, respectively, of lamp heat sink 100 of FIG. 1. Lamp heat sink 100 includes a base 102 for making contact with and providing support for an LED assembly (not shown), or other similar light generating assembly. Lamp heat sink 100 is configured to dissipate heat and to help ensure a lamp, within which heat sink 100 is disposed, functions properly, even at high temperatures. Lamp heat sink 100 includes a bottom threaded portion 104 for coupling with a screw cap (not shown) or other similar hardware capable of forming an electrical connection.

Lamp heat sink 100 has a center body 114 below base 102 and also configured to dissipate heat. Fins 106 surround center body 114 of lamp heat sink 100. Fins 106 protrude outward and away from center body 114 of lamp heat sink 100. Fins 106 extend the height of lamp heat sink 100, vertically from top to bottom of lamp heat sink 100. In one example, fins 106 extend a partial height lamp heat sink 100.

Heat sink 100 includes a circumferent skirt 108 to increase the surface area of the heat sink 100. Specifically, heat sink 100 comprises additional material for dissipating heat, or cooling surface inserts between each vertical fin 106, parallel to center body 114. Although additional material is used, fins 106 still provide the shape and look of lamp heat sink 100. In other words, circumferent skirt 108 does not affect the shape and look provided by the fins 106. Thus, including circumferent skirt 108 increases the effective surface area of lamp heat sink 100 without increasing the physical overall size of lamp heat sink 100. Circumference skirt 108, and lamp heat sink 100, can be plastic, thermo-plastic, metal, or other suitable material capable of dissipating heat.

In one aspect of the present disclosure, the circumferent skirt 108 is configured to be reflective. For example, circumferent skirt 108 comprises a material that reflects light or is coated with a material that reflects light. Additionally, circumferent skirt 108 may be configured at an angle that most efficiently reflects light in combination with a dome, bulb, or other cover (not shown), for example. Specifically, when a bulb is placed over lamp heat sink 100, light emitted from an LED disposed on to lamp heat sink 100 may be reflected back towards lamp heat sink 100 by the inside of the over. Having a reflective circumferent skirt 108 incorporated into the fins 106 enables at least some of the light to be reflected back out towards the bulb which helps to better distribute light from the lamp.

In one aspect of the present disclosure, lamp heat sink 100 also has exhaust openings 110 and intake openings 112. Exhaust openings 110 and intake openings 112 are defined by circumferent skirt 108, center body 114 of lamp heat sink 100, and fins 106. Exhaust openings 110 are located around the top of lamp heat sink 100 while intake openings 112 are located around the center or bottom area of lamp heat sink 100, depending on the length of circumference skirt 108. Intake openings 112 and exhaust openings 110 improve the efficiency of lamp heat sink 100 by providing a number of pockets, or channels, around lamp heat sink 100 between fins 106 and circumferent skirt 108, for allowing heated air to escape while allowing cool air to enter and pass through heat sink 100. By means of convection, the warmer air is released through exhaust openings 110 which allows for cooler air to enter through intake openings 110. Exhaust openings 110 in combination with the intake openings 112 create a chimney effect.

It should be understood that, although intake openings 112 are illustrated as being positioned near the bottom of lamp heat sink 100 while exhaust openings 110 are illustrated as being positioned near the top of lamp heat sink 100, intake openings 112 and exhaust openings can be reversed such that the openings near the top of lamp heat sink 100 function as intake and the openings near the bottom of lamp heat sink 100 function as exhaust.

It should be further understood that, although circumferent skirt 108 is illustrated as extending vertically approximately half the length of fins 106, circumferent skirt 108 may also be configured to be longer or shorter, depending on the heat dissipation requirements for a particular heat sink. For example, a longer circumferent skirt may provide for additional surface for absorbing heat without changing the overall shape of the heat sink.

It should be further understood that, although fins 106 are illustrated as being substantially linear, fins 106 may be non-linear as well. For example, fins 106 may be undulated, or wave-shaped (not shown). The undulations designed into each of the fins 106 further increases the effective surface area of lamp heat sink 100 without increasing the physical overall size of lap heat sink 100. Fins 106 may also be other suitable, non-linear, forms that may similarly increase the effective surface area of lamp heat sink 100 without increasing the physical overall size of lamp heat sink 100.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of aspects of the present disclosure thereof, and while the aspects of the present disclosure have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A lamp heat sink including a center body, the lamp heat sink comprising:

a plurality of heat dissipating fins disposed around the center body and extending away from the center body, wherein each of the plurality of heat dissipating fins define an outermost surface;

a heat dissipating circumferent skirt surrounding the center body and disposed between the plurality of heat dissipating fins, the heat dissipating circumferent skirt defining an outer surface, wherein the outermost surface of each of the plurality of fins extend further radially away from the center body of the heat sink than the outer surface of the heat dissipating circumferent skirt; and a plurality of channels disposed around the center body, formed by the plurality of heat dissipating fins and the heat dissipating circumferent skirt, the plurality of channels each comprising:

an intake opening configured to receive cold air; and an exhaust opening configured to release warm air.

2. The lamp heat sink of claim 1, wherein the plurality of fins are undulated.

3. The lamp heat sink of claim 1, wherein the plurality of fins are disposed vertically around the center body.

4. The lamp heat sink of claim 1, wherein the circumferent skirt comprises a reflective coating.

5. The lamp heat sink of claim 1, wherein the intake opening is disposed proximate to the bottom of the lamp heat sink, and wherein the exhaust opening is disposed proximate to the top of the lamp heat sink.

6. The lamp heat sink of claim 1, wherein the heat dissipating circumferent skirt comprises a height substantially equal to a height of the plurality of heat dissipating fins.

7. A heat sink including a center body, the heat sink comprising:

a plurality of heat dissipating fins disposed around the center body and extending away from the center body, wherein each of the plurality of heat dissipating fins define an outermost surface;

a plurality of channels surrounding the center body, the plurality of channels being defined by a plurality of heat dissipating inserts, disposed between the plurality of fins, parallel to the center body, the plurality of heat dissipating inserts defining an outer surface, wherein the outermost surface of each of the plurality of fins extend further radially away from the center body of the heat sink than the outer surface of the plurality of heat dissipating inserts;

a plurality of intake openings configured to receive cold air in the plurality of channels; and a plurality of exhaust openings configured to release warm air from the plurality of the channels.

8. The heat sink of claim 7, further comprising a reflective coating.

9. The heat sink of claim 7, wherein the plurality of fins are wave-shaped.

10. The heat sink of claim 7, wherein the plurality of heat dissipating fins and the plurality of heat dissipating inserts are disposed vertically around the center body.

11. The heat sink of claim 7, wherein a length of the plurality of heat dissipating fins is substantially equal to a length of the plurality of heat dissipating inserts.

12. A light emitting diode (LED) lamp, comprising:

at least one LED for generating light; and a lamp heat sink including a center body, the lamp heat sink comprising:

a base for providing support to the at least one LED;

a plurality of heat dissipating fins disposed around the center body and extending away from the center body, wherein each of the plurality of heat dissipating fins define an outermost surface;

a heat dissipating circumferent skirt surrounding the center body and disposed between the plurality of heat dissipating fins, the heat dissipating circumferent skirt defining an outer surface, wherein the outermost surface of each of the plurality of fins extend further radially away from the center body of the heat sink than the outer surface of the heat dissipating circumferent skirt; and a plurality of channels disposed around the center body, formed by the plurality of heat dissipating fins and the heat dissipating circumferent skirt, the plurality of channels each comprising:

an intake opening configured to receive cold air; and an exhaust opening configured to release warm air.

13. The LED lamp of claim 12, wherein the plurality of fins are undulated.

14. The LED lamp of claim 12, wherein the plurality of fins are disposed vertically around the center body.

15. The LED lamp of claim 12, wherein the circumferent skirt comprises a reflective coating.

16. The LED lamp of claim 12, wherein the intake opening is disposed proximate to the bottom of the lamp heat sink, and wherein the exhaust opening is disposed proximate to the top of the lamp heat sink.

17. The LED lamp of claim 12, wherein the heat dissipating circumferent skirt comprises a height substantially equal to a height of the plurality of heat dissipating fins.

* * * * *